US007900463B2

(12) United States Patent
Barone et al.

(10) Patent No.: US 7,900,463 B2
(45) Date of Patent: Mar. 8, 2011

(54) METHOD FOR CONTROLLING A FOOD FAST FREEZING PROCESS IN A REFRIGERATOR AND REFRIGERATOR IN WHICH SUCH METHOD IS CARRIED OUT

(75) Inventors: Diego Barone, Bergamo (IT); Carolina Biotti, Vedano Olona (IT); Lorenzo Bianchi, Varese (IT); Raffaele Paganini, Varese (IT); Alessandro Boer, Cassinetta di Biandronno (IT)

(73) Assignee: Whirlpool Corporation, Benton Harbor, MI (US)

( * ) Notice: Subject to any disclaimer, the term of this patent is extended or adjusted under 35 U.S.C. 154(b) by 527 days.

(21) Appl. No.: 11/947,208

(22) Filed: Nov. 29, 2007

(65) Prior Publication Data

US 2008/0115511 A1 May 22, 2008

(30) Foreign Application Priority Data

Nov. 30, 2006 (EP) ..... 06125087

(51) Int. Cl.
*G05D 23/32* (2006.01)

(52) U.S. Cl. ..... 62/157; 62/129; 62/126; 62/130

(58) Field of Classification Search ..... 62/155, 62/231, 129, 126, 130, 50.2, 52.1, 50.4; 374/141, 374/149, 134, 10, 16
See application file for complete search history.

(56) References Cited

U.S. PATENT DOCUMENTS

| | | | | |
|---|---|---|---|---|
| 2,649,702 | A * | 8/1953 | Kellie | 62/65 |
| 2,983,619 | A * | 5/1961 | Shaw, Jr. et al. | 426/324 |
| 3,339,377 | A * | 9/1967 | Fellwock | 62/408 |
| 3,494,138 | A * | 2/1970 | Bird | 62/151 |
| 3,733,848 | A * | 5/1973 | Duron et al. | 62/381 |
| 3,868,827 | A * | 3/1975 | Linhardt et al. | 62/63 |
| 3,958,428 | A * | 5/1976 | Kelso | 62/69 |
| 4,315,409 | A * | 2/1982 | Prentice et al. | 62/63 |
| 4,697,429 | A * | 10/1987 | Chandler et al. | 62/203 |
| 4,726,195 | A * | 2/1988 | Klee | 62/62 |
| 5,033,272 | A * | 7/1991 | Yoshikawa et al. | 62/199 |
| 5,267,449 | A * | 12/1993 | Kiczek et al. | 62/86 |
| 5,762,119 | A * | 6/1998 | Platz et al. | 141/231 |
| 5,787,718 | A * | 8/1998 | Jeong | 62/157 |
| 6,158,227 | A * | 12/2000 | Seeley | 62/56 |
| 6,233,966 | B1 * | 5/2001 | Delpuech et al. | 62/374 |
| 6,299,920 | B1 * | 10/2001 | Saksena | 426/231 |
| 6,637,932 | B2 * | 10/2003 | Badeer | 374/141 |
| 6,681,582 | B2 * | 1/2004 | Suzuki et al. | 62/129 |
| 6,779,918 | B2 * | 8/2004 | Gatling et al. | 374/134 |
| 6,789,391 | B2 * | 9/2004 | Graham et al. | 62/52.1 |
| 7,150,156 | B2 * | 12/2006 | Gatling et al. | 62/80 |
| 7,318,673 | B2 * | 1/2008 | Biscotti et al. | 374/141 |

(Continued)

FOREIGN PATENT DOCUMENTS

EP 0288967 A1 11/1988

(Continued)

*Primary Examiner* — George Nguyen
(74) *Attorney, Agent, or Firm* — John W. Morrison; Diederiks & Whitelaw PLC

(57) ABSTRACT

A method of fast freezing a food item using a freezing process that estimates a temperature value of a food item, selects from a plurality of freezing routines based on the estimated temperature, and activates the selected routine. This process is repeated until the temperature of the food item reaches a desired temperature.

19 Claims, 2 Drawing Sheets

U.S. PATENT DOCUMENTS

| | | | | |
|---|---|---|---|---|
| 7,596,432 | B2 * | 9/2009 | Boer et al. | 700/300 |
| 7,601,053 | B2 * | 10/2009 | Brandt et al. | 452/177 |
| 7,634,918 | B2 * | 12/2009 | Kawaguchi et al. | 62/126 |
| 2004/0050094 | A1 * | 3/2004 | Thonnelier et al. | 62/617 |
| 2004/0237547 | A1 * | 12/2004 | Delpuech et al. | 62/126 |
| 2005/0028534 | A1 * | 2/2005 | Li et al. | 62/6 |
| 2005/0217287 | A1 * | 10/2005 | Jeong et al. | 62/157 |
| 2006/0086107 | A1 * | 4/2006 | Voglewede et al. | 62/135 |
| 2006/0144053 | A1 * | 7/2006 | Zhang et al. | 62/6 |
| 2006/0162351 | A1 * | 7/2006 | Yahia | 62/129 |
| 2006/0207268 | A1 * | 9/2006 | Kelso et al. | 62/129 |
| 2007/0186562 | A1 * | 8/2007 | Kwon et al. | 62/48.1 |
| 2008/0115511 | A1 * | 5/2008 | Barone et al. | 62/62 |
| 2008/0202133 | A1 * | 8/2008 | Boer et al. | 62/126 |
| 2008/0221740 | A1 * | 9/2008 | Boer et al. | 700/300 |

FOREIGN PATENT DOCUMENTS

| | | | |
|---|---|---|---|
| EP | 1772691 | A1 | 4/2007 |

* cited by examiner

METHOD FOR CONTROLLING A FOOD FAST FREEZING PROCESS IN A REFRIGERATOR AND REFRIGERATOR IN WHICH SUCH METHOD IS CARRIED OUT

BACKGROUND OF THE INVENTION

1. Field of the Invention

The present invention relates to a method for controlling a refrigeration unit in order to carry out a so-called fast freezing of food items. With the term "refrigeration unit" we mean every kind of refrigeration appliance having a freezer compartment, either alone (chest freezer, vertical freezer) or in combination with a fresh food compartment (double door, side by side etc.). An example of method for controlling fast freezing is disclosed by EP-A-288967 where the duration of the fast freezing is automatically determined by measuring and comparing fast freezing cycle lengths.

2. Background

Existing products for food conservation in households allow freezing food items during their normal operations. These refrigerators can be divided into two categories: products with natural air convection and with forced air convection. So-called "no-frost" products use forced air convection and are able to remove moisture from the air in order to avoid manual defrosting.

According to present standards, food is considered frozen when its core temperature reaches about −18° C. within 24 hours after loading in the freezer. In general, this is a slow process that usually takes about 12 hours even when there's a dedicated compartment and/or operative mode for fast or quick-freezing. A well known consumer need is to have a freezing process as fast as possible.

SUMMARY OF THE INVENTION

According to the invention, this strategy first identifies which phase of freezing is occurring, and then creates the best freezing process condition during each phase. Preferably the control method according to the invention identifies which one of three phases of freezing is occurring. The freezing process can be divided into three consecutive steps.

In a first step, when a food item at normal ambient temperature is introduced in the freezer compartment, its temperature is decreased until about 0° C. when the phase change of water inside the food begins.

In a second step the phase change proceeds until the temperature reach a value for which about ¾ of the freezable water is converted to ice. This is the longest step because it needs the highest amount of heat transfer.

In a third step, the food item temperature is lowered until it reaches the standard temperature setting of the freezer, or colder temperature which is about −18° C. or 0° F.

The freezing of foodstuffs (heterogeneous system) is more complex than the freezing of pure water (homogeneous system). The different freezing point and freezing process depend on the molar concentration of the dissolved substances in food matrix, as it is clearly shown in the attached FIG. 1. The presence of solute determines a lower initial freezing point.

The water freezing process can be divided into two main stages.

In a first stage ice crystals formation happens. This stage is usually called "nucleation phase". Starting from water molecules, water changes its physical state to solid and small ice crystals are formed.

In a second stage these small ice crystals gather to form larger crystals. This stage is called "ice crystals growth phase". Crystal size varies inversely with the number of nuclei formed.

As it can be seen in the attached FIG. 2, nucleation requires several degrees of supercooling. In fact, energy is needed to overcome the free energy that accompanies the formation of a new phase (from a melted phase to an ordered solid particle). On the other hand, crystal growth is possible with minimal supercooling. So, the ice crystal growth process depends on the rate of cooling: a quicker heat transfer promotes ice crystals nucleation rather than ice crystal growth and so inside food tissues there will be smaller crystals.

During these two stages of water freezing, food items' tissues are affected by the size of ice crystals. Small crystals (from 20 to 65 micrometers) will not damage the tissues' cell walls, while large crystals (up to 170 micrometers) will break cells' walls and after thawing these damaged cells will loose all their content.

This causes several disadvantages for consumers after food thawing: loss of weight, loss of nutritional compounds (hydro-soluble vitamins, minerals etc.), loss of structural consistency, reduced quality and appeal. The original quality of the food is thus greatly reduced.

To avoid this cellular damage, the applicant has implemented a strategy to control ice crystals nucleation and growth in order to ensure that only small ice crystals will be present inside the food at the end of the freezing process.

Another issue related to the fast freezing process is the so-called freezing burns. This damage involves the external food tissues and it is due to a violent loss of water from the most external layers of tissues. It appears in the form of browning and dehydration of the external surface.

This loss of water occurs mainly as a consequence of the high temperature difference between air and food that is needed for the freezing process. Air at different temperatures has different partial pressure of water: during the freezing process the partial pressure of water vapour in cold air is much lower than that inside the food item. This creates a gradient of pressure that drives water out of the food tissues, starting from the most external layers.

In this regard forced air convection is more critical than static convection. On the contrary, in case of heat transfer by conduction, there's no risk of freezing burns because food is in contact with a cold solid surface and no water extraction can happen.

To avoid freezing burns damage when using a no-frost system based on forced air convection, it is necessary to reduce air velocity and control the temperature difference to avoid a large vapour pressure gradient during freezing process. In order to avoid freezing burns during storage, food items should be wrapped and large temperature swings should be avoided.

However this solution slows the overall freezing process. Another solution to avoid freezing burns is to adopt a proper packaging for the food item, as vacuum packaging or plastic film wrapping in full contact with the food. However domestic appliances cannot detect the presence of a proper packaging around the food, and this often leads to the issue of freezing burns.

Thus, to allow for the best quality of food after freezing and thawing, in case of any kind of packaging, a compromise is needed between high amounts of cold air and a slow, gradual freezing process with static air. For the purpose of cooling the food in the quickest time, in order to create only small ice crystals and thus preserve the food quality after thawing, it is necessary to use very fast heat transfers that can be done with fast and very cool flowing air. For the purposes of avoiding freezing burns and preserve the food quality after freezing, it is necessary to avoid fast and very cool airflow hitting the food or switching to a conductive heat transfer process.

The applicant discovered a solution that is a control strategy for a household freezer appliance that is able to provide at the same time.

This control strategy can accomplish improved freezing of food, and various embodiments may accomplish one or more of the following:

Significantly reduced overall freezing time;

Prevention of freezing burns (optimal food quality after freezing); and

Dramatic reduction of large ice crystals formation (optimal food quality after thawing)

The overall algorithm implementing the method according to the invention can be divided into two main parts, i.e. an estimation part and an actuation part.

The estimation part has the objective of converting the measured air temperature inside the cavity into an estimation of the temperature of the food item or items under freezing. This part is continuously running during the entire freezing process and will periodically update the estimation of the food temperature. The estimation part of the method/algorithm has been already disclosed by the applicant in the European patent application 05109380.5, EP 1 772 691 A1 and in U.S. patent application Ser. No. 11/539,190 with reference to a method for cooling a container or bottle in a freezer. According to such estimation technique, the temperature of the container, bottle or (in the present case) food item is estimated on the basis of the compressor status and of the sensed temperature of the zone in which the food item is placed.

The control part will receive as input the estimated food temperature ($T_{food}$) provided by the estimation part and will decide the correct actuation part by consequence, according to the food preservation constraints previously described.

The actions taken by the control part are here briefly summarised.

In the first phase food temperature starts from external ambient T and must reach the freezing temperature. In this phase the most freezing burns happen, due to the high temperature difference. Thus, in this phase the strategy according to the present invention will control air temperature and velocity, plus the possibility to activate a cold surface in contact with food to implement conductive heat transfer. This phase will be active until the estimated temperature of the food item is lower than a predetermined value $T_1$ ($T_{food}<T_1$). $T_1$ is predetermined parameter of the control and its value will depend on the application, anyway its value will be "close enough" to the freezing temperature of 0° C. The analysis of the probe temperature derivative can be used in support to the above mentioned estimation techniques to "refine" the estimation of the food temperature ($T_{food}$) during this phase.

In the second phase, the highest amount of heat transfer is needed to provide the fast freezing associated with the formation of only small crystals. In this phase all the possible means for heat transfer are operated at maximum capacity.

This phase will be active until the estimated temperature of the food item is lower than a predetermined value $T_2$ ($T_{food}<T_2$). $T_2$ will be a parameter of the control algorithm, and a typical value thereof is comprised in the range about −10° C. and −4° C., a preferred value being around −7° C. In case of a multi-compartment appliance this phase could require the total (or partial) suspension of the cooling action of the other compartments. This would provide the maximum cooling capacity to the shock-freezing compartment, being the time duration of this phase very critical for the effectiveness of the overall shock freezing process. The food temperature estimation, in this phase can be "refined" by signal processing of the well known "plateau effect" presented by the measured probe temperature during the ice formation phase.

In the third phase it is necessary to maintain the fastest heat transfer to reach the desired short overall process duration.

Such a strategy is able to overcome all the food preservation issues while at the same time providing the desired consumer benefit of the shortest freezing time.

BRIEF DESCRIPTION OF THE DRAWINGS

Further features and advantages of a method and of a freezer according to the present invention will be clear from the following detailed description of an example, with reference to the attached drawings in which.

DETAILED DESCRIPTION OF THE PREFERRED EMBODIMENTS

Figure 1:
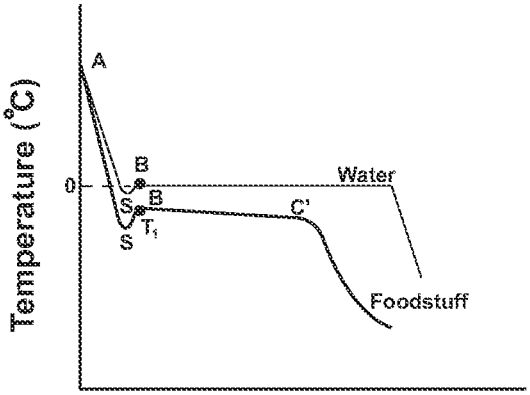
FIG. 1 shows temperature-time curves for pure water and foodstuff.
Figure 2:
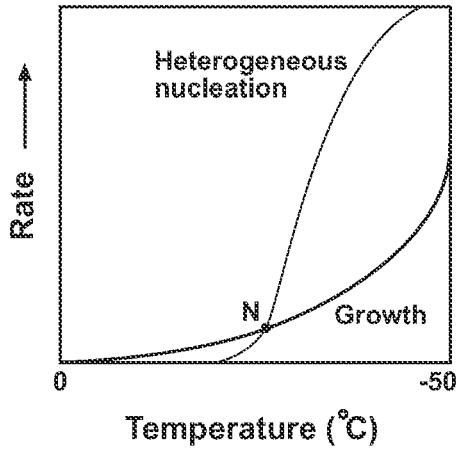
FIG. 2 shows comparative rates of nucleation and crystal growth of water as influenced by supercooling.
Figure 3:
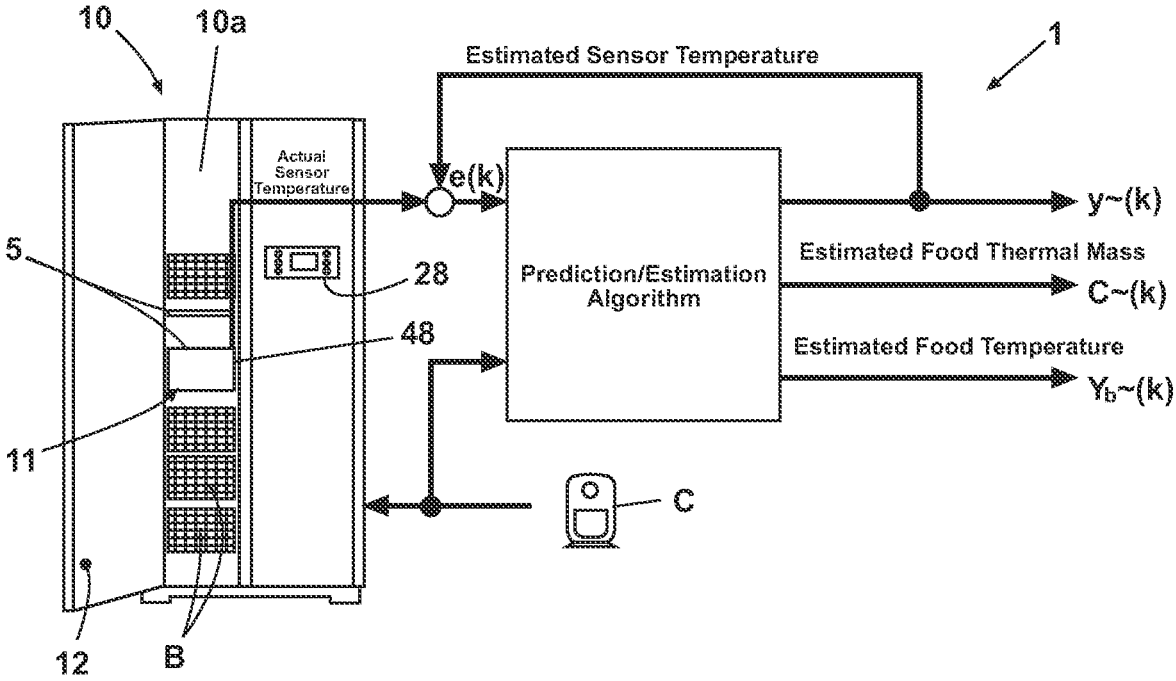
FIG. 3 shows a refrigerator according to the present invention.

With reference to FIG. 3, a refrigerator 10 comprises a freezer cavity 10*a* closed by a door 12 and a control process unit including a prediction/estimation algorithm. The freezer cavity presents shelves S and baskets B for storing different food products. A particular cavity defined by two consecutive shelves 11 is specifically designed for fast freezing of food items. In the cavity 11*a* temperature sensor 18 is placed.

An embodiment of invention may be better understood with an understanding of the heat exchange process in term of mathematical equations. This may be referred to as a "model based" solution. Alternatively, other solutions, based on "black box" approaches, can be used in describing the phenomenon and designing the estimation. In this case, the estimation algorithm would be based on a set of empirical relations (instead of a mathematical model) between the measured variable (i.e. the real sensor measure and the compressor speed or its ON/OFF state) and the estimated variables (food item thermal mass, food temperature). In general, such kind of solutions can be based on fuzzy logic and/or neural network techniques.

Alternatively the usage of advanced techniques (Kalman filtering, fuzzy logic, neural networks) can provide precise food item temperature estimation without particular constraints in the location of the real temperature sensor 18. For this reason, it may be preferable as a very cost-effective solution to use of the standard temperature sensor (normally used for the temperature control of the cavity) as actual sensor 18 for the above estimation.

In FIG. 3 it is shown how a "model based" algorithm according to the present invention works. The input data are the actual temperature measured by the sensor 18 and the status of the compressor C, i.e. its speed or its ON/OFF state. The output data of the algorithm is an estimated sensor temperature y(k), the estimated thermal mass of the food item $C_{food}(k)$ which is continuously updated during the fast freezing process and the estimated temperature of the food item $y_{food}(k)$. The estimated sensor temperature is used in a feedback control loop L for calculating the estimated error e(k) between the estimated sensor temperature and the actual temperature of the food item. The algorithm resides in the electronic circuit used for controlling the refrigerator. An example of application of model based estimation algorithm consists in providing a dedicated compartment for the fast freezing process where a cool forced air flow is blown and the food temperature inside the compartment is estimated through an energy balance between the inlet air flow temperature and the outlet air flow temperature. Further details of the estimation algorithm can be found in the European application 05109380.5, EP 1 772 691 A1 and in U.S. patent application Ser. No. 11/539,190 referenced prior in this Application.

Figure 4:
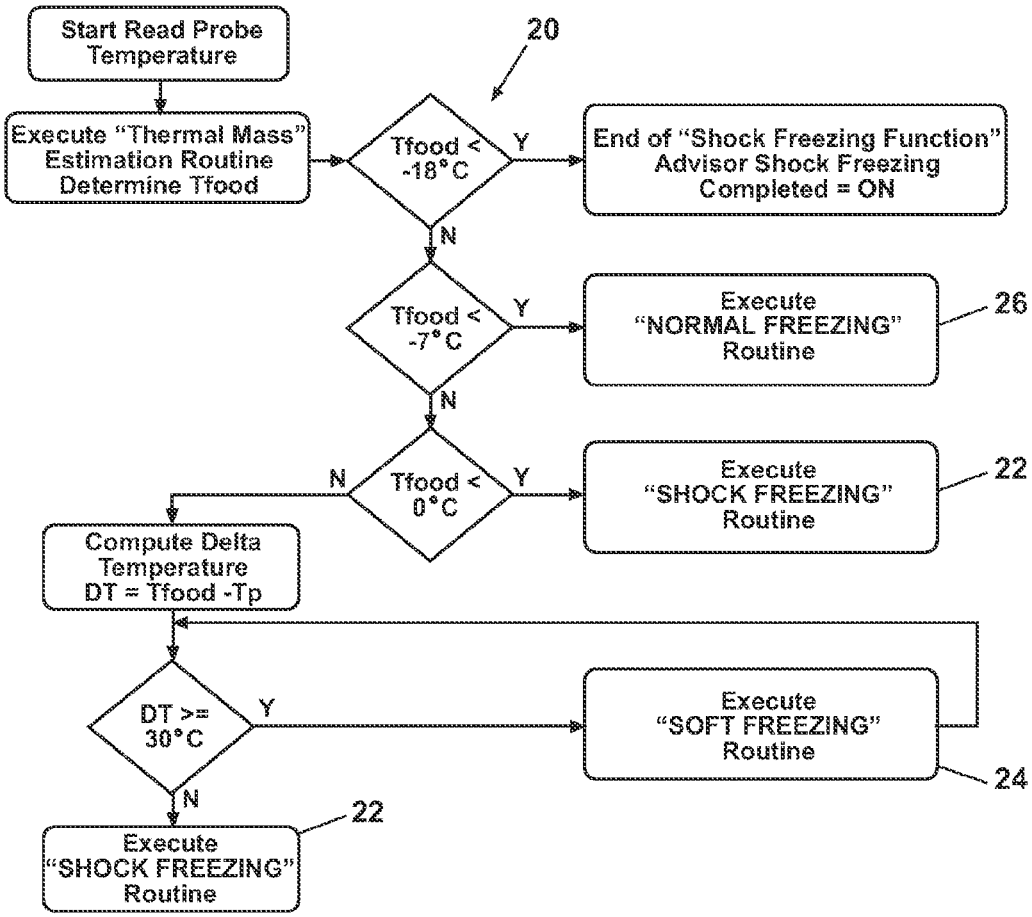
FIG. 4 shows an embodiment of the schematic flow chart of the method according to the invention which can be implemented in the refrigerator of FIG. 1.
Figure 5:
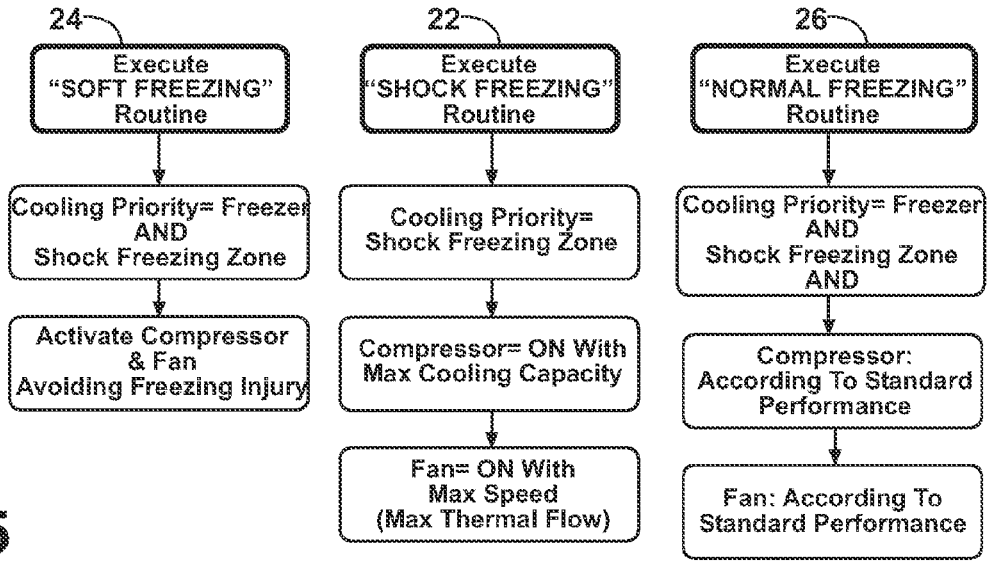
FIG. 5 shows three different routines linked to the flow chart of FIG. 3.

With reference to FIG. 4, the first step 20 of the actuation part of the method according to the invention is to compare the estimated food item temperature with three different threshold values. In one embodiment, if the estimated temperature of the food item is below −18° C., no fast freezing function is actually needed, or that the fast freezing process has been completed. If the estimated temperature of the food item is lower than 0° C. but higher than −7° C., then a "shock freezing routine" 22 is carried out (FIG. 5) according to which the cooling priority is given to the shock freezing zone, with fan circulating cold air at maximum speed. If estimated temperature of the food item is above 0° C., then a comparison is made with the actual sensed temperature Tp. If the difference between such temperatures is lower than 30° C., than the above shock freezing routine 22 is carried out. If such difference is higher than 30° C., than a "soft freezing routine" 24 (FIG. 5) is carried out where the full cooling capacity is not used for the fast freezing compartment in order to avoid freezing burns, and the remaining cooling capacity can be used to cool the food items further below their storage temperature to reduce their need for cooling during other phases. If the estimated temperature of the food item is comprised between −7° C. and −18° C., a so called "normal freezing routine" 26 (FIG. 5) is carried out, according to which not the entire cooling capacity of the refrigeration appliance is dedicated to the fast freezing compartment, while there is no longer risk of freezing burns.

The algorithm shown in FIG. 4 is preferably carried out consecutively several times in order to continuously check what is the optimal routine to be used (or changed) due to the estimated and actual conditions, taken for granted that usually the above routines are consecutive (from the soft freezing one, to the shock freezing one and to the normal one) and are triggered by the estimated temperature value according to the overall actuation routine of FIG. 4.

The refrigerator 10 comprises also a user interface 28 that is designed to provide visual and/or acoustic feedback to the user about the status of the fast freezing process or the remaining time to complete the fast freezing process.

The user interface 28 of the refrigerator 10 is positioned on the external surface of the appliance 10 or outside the compartment 11 but preferably integral to the appliance 10. According to the present invention, it is possible to obtain a frozen food quality enhancement by controlling the gradient of partial pressure of water vapour between cold air and food surface, in order to provide the optimal quality after freezing.

Moreover it is also obtained a frozen food quality enhancement by controlling the size of ice crystals inside food tissues, in order to provide the optimal quality after thawing.

The method according to the invention yields also a maximum convenience in terms of duration of the process, by means of an increased availability of the freezing function compared to existing domestic appliances.

We claim:

1. A method of fast freezing a food item in a refrigerating unit, including a freezer cavity which houses the food item, a door for selectively closing the freezer cavity and a cooling unit having a compressor for establishing a freezing temperature in the freezer cavity, comprising the steps of:

estimating the thermal mass of the food item, setting at least two fast freezing routines for the cooling unit based on the estimated thermal mass of a food item; and activating one of the fast freezing routines based on the estimation of the thermal mass to fast freeze the food item within the freezer cavity.

2. The method of claim 1, wherein the steps of estimating and activating are repeated at least once.

3. The method of claim 2 wherein the repeating of the estimating and activating continues until the food item reaches a desired temperature.

4. The method according to claim 1, wherein a first one of the fast freezing routines avoids using a maximum cooling capacity of the refrigerating unit for the fast freezing process, and wherein a second one of the fast freezing routines utilizes the maximum cooling capacity of the refrigerating unit for the fast freezing process.

5. The method of claim 4 where the step of estimating the thermal mass of the food item comprises the steps of: determining the status of the compressor, and determining a sensed temperature status of a zone where the food item is placed.

6. The method according to claim 5, further comprising estimating a temperature of the food item, wherein the first one of the fast freezing routines is activated if the estimated temperature of the food item is higher than about 0° C. and if a difference between the estimated temperature of the food item and the sensed temperature of the zone where the food item is placed is above a predetermined value.

7. The method according to claim 5, wherein the second one of the fast freezing routines is activated if the estimated temperature of the food item is lower than or equal to a predetermined upper value or if a difference between the estimated temperature of the food item and the sensed temperature of the zone where the food item is placed is below a predetermined value.

8. The method according to claim 7, wherein the predetermined upper value for the estimated temperature is about 0° C.

9. The method according to claim 8, wherein the predetermined value of the difference between the estimated temperature and the sensed temperature is about 30° C.

10. The method according to claim 6, wherein the predetermined value of the difference between the estimated temperature and the sensed temperature is about 30° C.

11. A refrigerating unit having fast freezing capabilities comprising:

a temperature sensor configured to measure a temperature inside the refrigerating unit;

a cooling unit including a compressor;

a control processor operatively connected to the temperature sensor and the compressor, wherein the control processor is configured to:

perform an estimation of the temperature of a food item placed in the refrigerating unit, wherein the estimation of the temperature of the food item utilizes an estimation of the thermal mass of the food item;

select from at least two freezing routines of the refrigerating unit based on the estimation; and activate the selected freezing routine.

12. The refrigerating unit according to claim 11, further comprising a specialty compartment for fast freezing from which the temperature sensor is able determine the temperature of the specialty compartment.

13. The refrigerating unit of claim 11 wherein the estimation of the thermal mass of the food item further comprises evaluating the status of the cooling unit and of the temperature of the sensor.

14. The refrigerating unit according to claim 12, wherein a first one of the freezing routines is activated if the estimated temperature of the food item is higher than about 0° C. and if a difference between the estimated temperature of the food item and the sensed temperature of the specialty compartment is above a predetermined value.

15. The refrigerating unit according to claim 14, wherein a second one of the freezing routines is activated if the estimated temperature of the food item is lower than or equal to a predetermined upper value or if the difference between the estimated temperature of the food item and the sensed temperature of the specialty compartment where the food item is placed is below a predetermined value.

16. The refrigerating unit according to claim 15, wherein the predetermined upper value for the estimated temperature is about 0° C. and the predetermined value for the difference between the estimated temperature and the sensed temperature is about 30° C.

17. The refrigerating unit according to claim 11 further comprising:

a user interface designed to provide feedback to the user on the status of the fast freezing process or the remaining time to complete the fast freezing process.

18. The refrigerating unit according to claim 17 wherein the feedback comprises both audible and visual feedback.

19. A method of fast freezing a food item including a freezing process comprising the steps of:

estimating a temperature of a food item, wherein the estimation of the temperature of the food item utilizes an estimation of the thermal mass of the food item;

selecting from a plurality of freezing routines based on the estimation, activating the selected routine, and repeating the freezing process until the temperature of the food item reaches a desired temperature.

* * * * *